US008079693B2

(12) United States Patent
Hoshino

(10) Patent No.: US 8,079,693 B2
(45) Date of Patent: Dec. 20, 2011

(54) LIQUID EJECTING DEVICE

(75) Inventor: Shuhei Hoshino, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 387 days.

(21) Appl. No.: 12/406,717

(22) Filed: Mar. 18, 2009

(65) Prior Publication Data

US 2009/0244226 A1 Oct. 1, 2009

(30) Foreign Application Priority Data

Mar. 26, 2008 (JP) ..... 2008-081871

(51) Int. Cl.
*B41J 2/19* (2006.01)
*B41J 2/17* (2006.01)

(52) U.S. Cl. ..... 347/92; 347/85; 347/84

(58) Field of Classification Search ..... 347/84, 347/85, 86, 92, 93, 87
See application file for complete search history.

(56) References Cited

U.S. PATENT DOCUMENTS

| | | | | |
|---|---|---|---|---|
| 4,380,770 | A * | 4/1983 | Maruyama | 347/92 |
| 6,082,851 | A * | 7/2000 | Shihoh et al. | 347/85 |
| 6,224,201 | B1 * | 5/2001 | Shigemura | 347/93 |
| 7,559,615 | B2 * | 7/2009 | Eve | 347/92 |

FOREIGN PATENT DOCUMENTS

| | | | |
|---|---|---|---|
| JP | 2-179757 | A | 7/1990 |
| JP | 3-234651 | A | 10/1991 |
| JP | 3-274165 | A | 12/1991 |
| JP | 3-293152 | A | 12/1991 |

* cited by examiner

*Primary Examiner* — Manish S Shah
(74) *Attorney, Agent, or Firm* — Birch, Stewart, Kolasch & Birch, LLP

(57) ABSTRACT

Ink is supplied to a supply tank from a second buffer tank, and ink is pressure-fed from the supply tank to a head. Further, ink is supplied from the second buffer tank to a recovery tank, and ink is pressure-fed from the recovery tank to the head. In both pressure-feedings, ink containing air bubbles within the head is recovered at a first buffer tank. The ink, that contains the air bubbles and is recovered at the first buffer tank, is sent to the second buffer tank via an ink flow path. A degassing section is provided on the ink flow path, and a degassing process is carried out while ink is being fed.

2 Claims, 14 Drawing Sheets

LIQUID EJECTING DEVICE

CROSS-REFERENCE TO RELATED APPLICATIONS

This application claims priority under 35 USC 119 from Japanese Patent Application No. 2008-081871, the disclosure of which is incorporated by reference herein.

BACKGROUND OF THE INVENTION

1. Field of the Invention

The present invention relates to a liquid ejecting device. In particular, the present invention relates to a liquid ejecting device that can remove air bubbles that are generated in a liquid flow path.

2. Description of the Related Art

In inkjet printers, air bubbles that arise at an ejecting head that ejects ink are a cause of non-ejecting of the ink. Further, in a device that circulates ink in pipes of a circulating system and supplies ink to an ejecting head, there are cases in which air bubbles exist not only in the ejecting head, but within the ink path as well. In such cases, the flow path resistance increases, and ink cannot be supplied sufficiently to the ejecting head. Moreover, in the case of a device that uses an elongated ejecting head as the ejecting head, the ink path is long and the shape of the circulating path is complex. Therefore, the flow path resistance is large, and is difficult to trap and remove the air bubbles. Accordingly, in such a device, removal of air bubbles is necessary not only within the elongated head, but at the entire ink supply path as well.

Japanese Patent Application Laid-Open (JP-A) No. 3-234651 (document 1), JP-A No. 3-274165 (document 2), JP-A No. 2-179757 (document 3) and JP-A No. 3-293152 (document 4), that will be described hereinafter, are known as techniques for removing air bubbles.

In the devices disclosed in document 1, document 2 and document 3, a recording head (ejecting head) and an ink supply tank are connected by a supply pipe and a circulating pipe. At the time of the recording operation, the device supplies ink from the ink supply tank to the recording head through the supply pipe. At the time of the recovery operation, the device uses a recovery pump to send the ink through the circulating path to the recording head from the direction opposite the ink flowing direction at the time of the recording operation, and carries out bubble removal and the like.

Further, in the device disclosed in document 4, the recording head and an ink storage tank are connected by a supply pipe and a return pipe. A valve, a mesh filter, a waste ink tank and a pump are provided at the supply pipe. The pressure-feeding direction of the ink that is pressure-fed by the pump is reversed at times of a usual recovery operation and times of a non-ejecting recovery operation. Due thereto, in this device, foreign matter is caught at the valve side of the mesh filter at times of the usual recovery operation, whereas, at times of the non-ejecting recovery operation, the trapped foreign matter is pulled apart from the mesh filter and, together with ink, flows into the waste ink tank.

However, in the devices disclosed in documents 1 to 3, at times of the recovery operation (bubble removal), ink is pressure-fed only in one direction with respect to the circulating path. In pressure-feeding the ink in the one direction, the way that the ink flows within the path is limited, and therefore, there exist air bubbles that cannot be completely captured in light of the structure of the path. Further, in the device disclosed in document 4, the ink is pressure-fed in both directions with respect to the circulating path, and the ink that is pressure-fed from the recording head is returned to the supply tank and a portion thereof is subjected to waste liquid treatment. However, this treatment is for the purpose of preventing clogging of the filter, and removal of air bubbles that are within the circulating path cannot be carried out. Moreover, in the devices disclosed in documents 1 and 4, when removing air bubbles that are within the path, ink is wasted because ink that includes air bubbles is discharged from the nozzles for ink ejection. In addition, when the ink that includes air bubbles is not discharged from the nozzles, ink that includes air bubbles and ink that does not include air bubbles mix together within the supply tank. As a result, ink that contains air bubbles is again supplied to the ejecting head.

SUMMARY OF THE INVENTION

The present invention provides a liquid ejecting device that has an excellent ability to remove air bubbles.

A first aspect of the present invention is a liquid ejecting device including: an ejecting head including a liquid chamber configured to store a liquid, and that ejects liquid that is within the liquid chamber; a first tank configured to temporarily store liquid that is to be supplied to the liquid chamber, and temporarily stores liquid that is recovered from the liquid chamber, and communicates with the liquid chamber; a second tank configured to temporarily store liquid that is to be supplied to the liquid chamber, and temporarily stores liquid that is recovered from the liquid chamber, and communicates with a portion of the liquid chamber which portion is different than a portion of the liquid chamber that is in communication with the first tank; a degas device degassing gas within recovered liquid; a first flow path communicating the first tank and the degas device, a first pump being provided within the first flow path; a second flow path communicating the second tank and the degas device, a second pump being provided within the second flow path; and a control section controlling the first pump and the second pump, wherein the control section, effects control such that liquid, that is degassed at the degas device, is supplied to the liquid chamber via the first flow path and the first tank, and liquid that is within the liquid chamber is recovered at the degas device via the second tank, and effects control such that liquid, that is degassed at the degas device, is supplied to the liquid chamber via the second flow path and the second tank, and liquid that is within the liquid chamber is recovered at the degas device via the first tank.

In accordance with the first aspect, liquid is pressure-fed separately from both directions to the ejecting head. Therefore, even when the flow path of the liquid is complex and is easy for air bubbles to become trapped, the trapped air bubbles can be removed, and the air bubble removing ability improves. Further, the liquid that is pressure-fed is recovered at the degas device and degassed. Therefore, as compared with a case in which ink is ejected and liquid that includes air bubbles is discharged, liquid is not wasted and the amount that is consumed can be suppressed.

The liquid is pressure-fed from both directions to the ejecting head, by using the two tanks that are the first tank and the second tank. Therefore, sudden changes in pressure can be absorbed, and pressure control also is easy. Further, by using the two pumps that are the first pump and the second pump, pressure with respect to the first and second flow paths is controlled, and pressure that is sufficient for pressure-feeding the liquid can be applied. Moreover, breakage of the ejecting head due to excessive application of pressure can be prevented.

In a second aspect of the present invention, the above-described aspect may further include an air bubble supplying section that supplies air bubbles to at least one of the first flow path or the second flow path, and the control section may control the air bubble supplying section such that air bubbles are supplied, and may control the first pump and the second pump such that liquid, that includes the supplied air bubbles, passes through the first tank and the second tank and is recovered at the degas device.

Air bubbles, that exist at the wall surfaces of the first tank and the second tank such that they stick thereto, are difficult to remove by pressure-feeding a liquid. Accordingly, as in the second aspect of the present invention, air bubbles are supplied to the flow paths, and the liquid that includes the supplied air bubbles is made to flow by the first pump and the second pump such that the supplied air bubbles are degassed at the degas device. Due thereto, the air bubbles that exist not only in the flow paths but also at the wall surfaces of the first tank and the second tank and the like, the supplied air bubbles merge together and become a large air bubble, and the large air bubble is sent to the degas device and degassed. Therefore, even air bubbles that are difficult to remove can be removed, and the air bubble removing ability can be improved.

As described above, the present invention can remove well the air bubbles that are generated in an ejecting head, and in flow paths through which liquid is fed, and the like.

BRIEF DESCRIPTION OF THE DRAWINGS

Exemplary embodiments of the present invention will be described in detail based on the following figures, wherein.

DETAILED DESCRIPTION OF THE INVENTION

An example of an exemplary embodiment of the present invention will be described in detail hereinafter with reference to the drawings.

Figure 1:
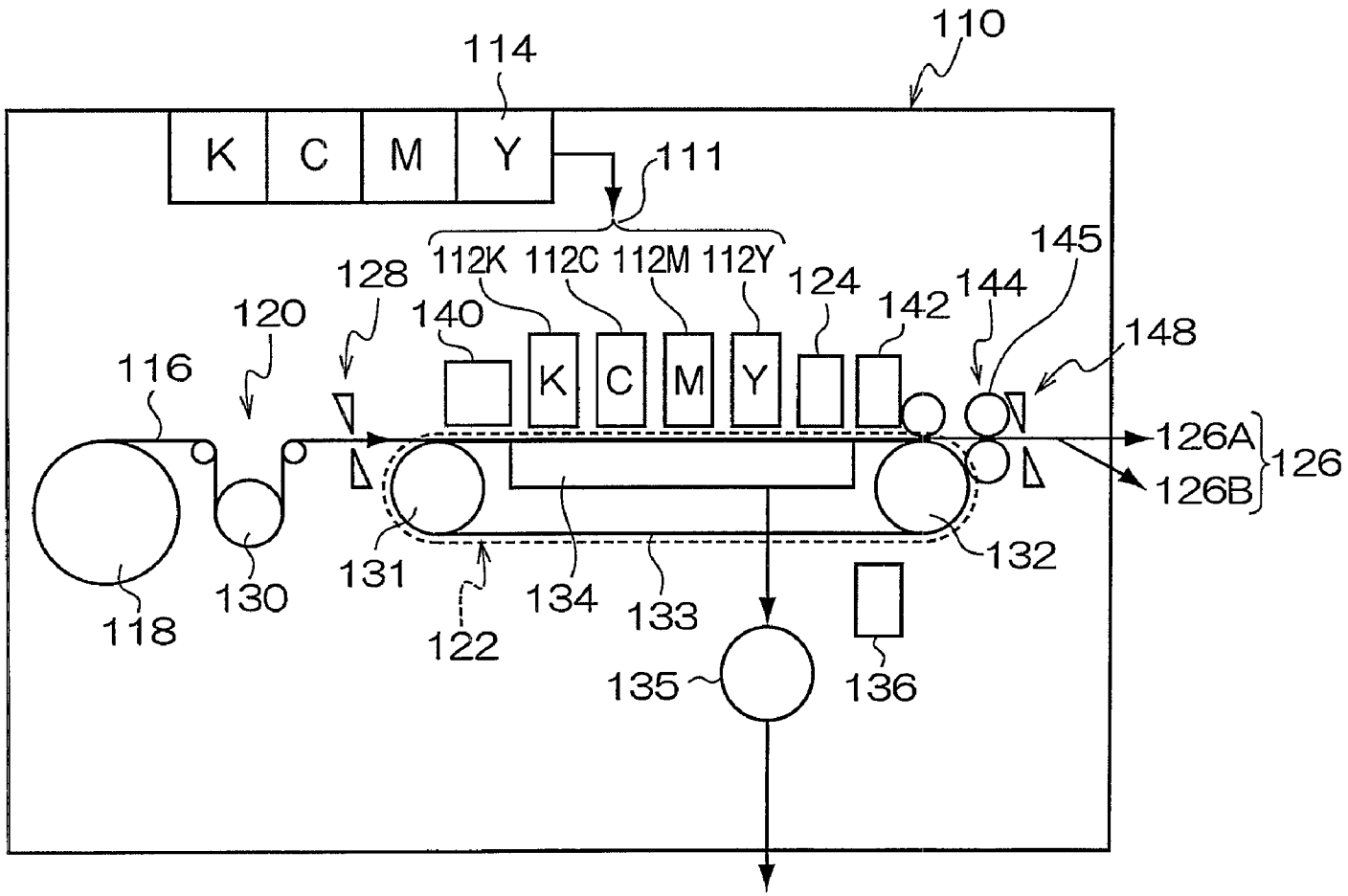
FIG. 1 is an overall structural drawing of an inkjet recording device showing an exemplary embodiment of a liquid ejecting device relating to the present invention.

FIG. 1 is an overall structural drawing of an inkjet recording device showing an exemplary embodiment of a liquid ejecting device relating to the present invention. As shown in FIG. 1, an inkjet recording device 110 includes a printing section 111, an ink storing/loading section 114, a paper feeding section 118, a decurling process section 120, a belt conveying section 122, a print detecting section 124, and a paper discharging section 126. The printing section 111 has plural inkjet recording heads (hereinafter called heads) 112K, 112C, 112M, 112Y that are provided in correspondence with respective inks of black (K), cyan (C), magenta (M) and yellow (Y). The ink storing/loading section 114 stores the inks that are supplied to the respective heads 112K, 112C, 112M, 112Y. The paper feed section feeds recording paper 116 that is a recording medium. The decurling process section 120 removes the curl of the recording paper 116. The belt conveying section 122 is disposed so as to oppose the nozzle surfaces (ink ejecting surfaces) of the printing section 111, and conveys the recording paper 116 while maintaining the flatness of the recording paper 116. The print detecting section 124 reads-out the results of printing by the printing section 111. The paper discharging section 126 discharges the recorded recording paper (printed matter) to the exterior. Note that, in the present application, "printing" includes the printing of images in addition to the printing of characters.

The ink storing/loading section 114 includes main tanks that store the inks of the colors corresponding to the heads 112K, 112C, 112M, 112Y. The tanks communicate with the heads 112K, 112C, 112M, 112Y via necessary pipes. Further, the ink storing/loading section 114 includes a notifying section that, when the remaining amount of ink becomes low, gives notice of that fact. The ink storing/loading section 114 has the function of preventing erroneous loading among the colors. The detailed structure of the ink storing/loading section 114 will be described later.

A magazine of roll paper (a continuous sheet of paper) is shown in FIG. 1 as an example of the paper feeding section 118. However, plural magazines that have different paper widths, paper qualities, and the like may be used in combination. Further, instead of a magazine of roll paper, or in combination therewith, cut sheets may be supplied by a cassette in which the cut sheets are loaded in a stacked manner.

In the case of a structure that can utilize plural types of recording media, an information recording body, such as a barcode or a radio tag or the like on which information of the type of the medium is recorded, is attached to the magazine, and the information of that information recording body is read by a predetermined reading device. The types of recording media (types of media) that are used are thereby distinguished automatically, and it is preferable to carry out ink ejection control so as to realize ink ejection that is appropriate in accordance with the type of the medium.

Curling due to having been loaded in the magazine remains in the recording paper 116 that is fed-out from the paper feeding section 118, such that the paper curls. In order to remove this curl, the decurling process section 120 applies heat to the recording paper 116 by a heating drum 130 in the direction opposite to the direction of curling of the magazine.

At this time, the heating temperature is controlled such that the printing surface is weakly curled toward the outer side.

In the case of a device structure that utilizes roll paper, a cutter 128 for cutting is provided as shown in FIG. 1. The roll paper is cut to a desired size by the cutter 128. Note that the cutter 128 is not needed when cut sheets are used.

After the decurling process, the cut recording paper 116 is sent to the belt conveying section 122. The belt conveying section 122 has a structure in which an endless belt 133 is trained between rollers 131, 132.

The belt 133 has a widthwise dimension that is wider than the width of the recording paper 116. Numerous suction holes (not shown) are formed in the belt surface. As shown in FIG. 1, an attracting chamber 134 is provided at the inner side of the belt 133, at a position opposing the nozzle surfaces of the printing section 111 and the sensor surface of the print detecting section 124. Due to the attracting chamber 134 being sucked by a fan 135 and being made to be negative pressure, the recording paper 116 is attracted to and held on the belt 133. Note that an electrostatic attraction method may be employed instead of a suction attraction method.

The power of a motor (not shown) is transferred to at least one of the rollers 131, 132 around which the belt 133 is wound. Due thereto, the belt 133 is driven in the clockwise direction in FIG. 1. The recording paper 116 that is held on the belt 133 is conveyed from left to right in FIG. 1.

When printing borderless prints or the like, ink adheres on the belt 133 as well. Therefore, a belt cleaning section 136 is provided at a predetermined position (an appropriate position other than the printing region) at the outer side of the belt 133. The belt cleaning section 136 may be a nipping type that creates a nip between a brush and a roller or between water-absorbing rollers, or the like, or an air blowing type that blows cleaning air out, or a combination of these, or the like. In the case of nipping by using rollers for cleaning, the results of cleaning are great when the belt linear speed and the roller linear speed are changed.

Note that an aspect can be considered that uses a roller nipping conveying mechanism instead of the belt conveying section 122. However, when conveying a sheet through a printing region by roller nipping, a roller contacts the printed surface of the sheet immediately after printing, and therefore, it is easy for the image to blur. Accordingly, conveying by an attraction belt that does not contact the image surface in the printing region, as in the case of the present example, is preferable.

A heating fan 140 is provided at the upstream side of the printing section 111, on the sheet conveying path that is formed by the belt conveying section 122. The heating fan 140 blows heated air out toward the recording paper 116 before printing, so as to heat the recording paper 116. By heating the recording paper 116 immediately before printing, it is easy for the ink to dry after landing on the paper.

Figure 2:
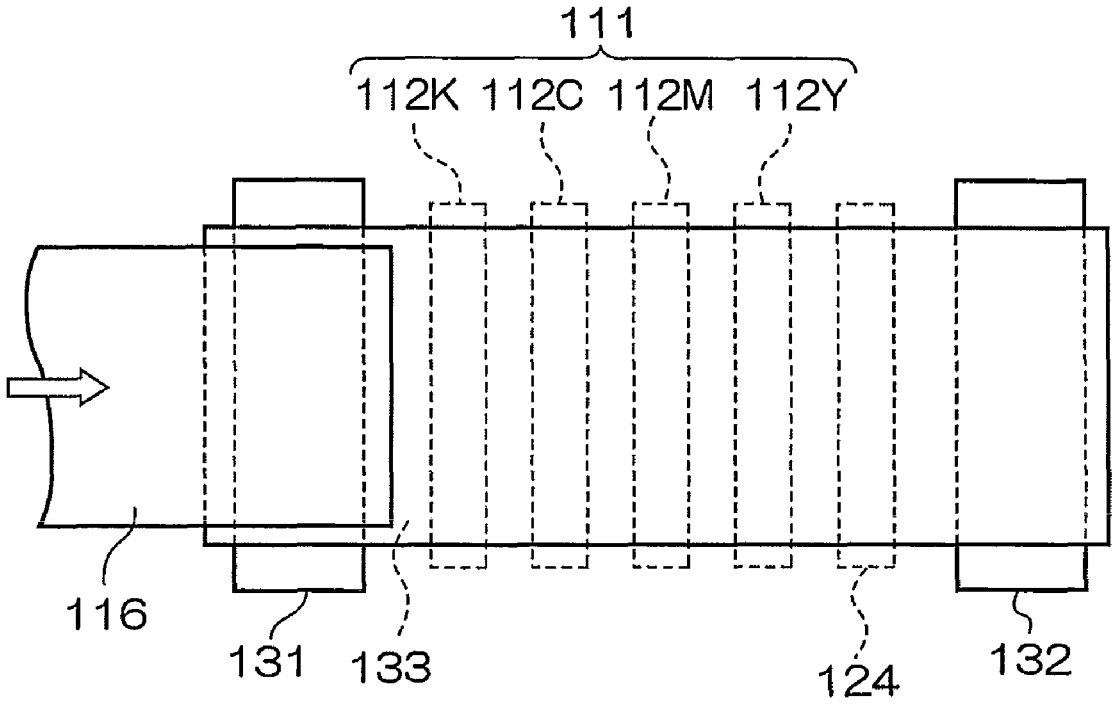
FIG. 2 is a plan view of main portions at the periphery of a printing section of the inkjet recording device relating to the present exemplary embodiment.

The respective heads 112K, 112C, 112M, 112Y of the printing section 111 have lengths that correspond to the maximum paper width of the recording papers 116 that are objects at the inkjet recording device 110. The heads 112K, 112C, 112M, 112Y are full-line type heads (see FIG. 2) in which plural nozzles for ink ejection are lined-up at the nozzle surfaces over a length exceeding at least one side of the recording paper 116 of the maximum size (i.e., over the entire width of the printable range).

The heads 112K, 112C, 112M, 112Y are disposed in the order of the colors of black (K), cyan (C), magenta (M), yellow (Y) from the upstream side along the direction of feeding the recording paper 116. The respective heads 112K, 112C, 112M, 112Y are fixed so as to extend along a direction that is substantially orthogonal to the conveying direction of the recording paper 116.

While the recording paper 116 is conveyed by the belt conveying section 122, a color image can be formed on the recording paper 116 by the heads 112K, 112C, 112M, 112Y ejecting inks of the respective, different colors.

In this way, in the recording device of the present exemplary embodiment, an image can be recorded on the entire surface of the recording paper 116 merely by the operation of relatively moving the recording paper 116 and the printing section 111 in the paper feeding direction (i.e., the sub-scanning direction) being carried out one time (i.e., by one sub-scan), in accordance with the structure in which the full-line-type heads 112K, 112C, 112M, 112Y, that have nozzle rows that cover the entire region of the width of the paper, are provided per color. Due thereto, as compared with a shuttle-type head in which a recording head operates reciprocally in the direction orthogonal to the paper conveying direction, high-speed printing is possible and produceability can be improved.

In the present example, a structure of the standard colors (four colors) of KCMY is exemplified. However, the combination of ink colors and number of inks is not limited to that of the present exemplary embodiment. Pale inks, deep inks, inks of special colors, and the like may be added as needed. For example, a structure to which are added inkjet heads that eject light inks such as light cyan, light magenta or the like, also is possible. Further, the order in which the heads of the respective colors are arranged also is not particularly limited.

The print detecting section 124 shown in FIG. 1 includes an image sensor (a line sensor or an area sensor) for picking-up the results of droplet ejection by the printing section 111. From an ejected droplet image that is read by the image sensor, the print detecting section 124 checks the ejection characteristics such as clogging of nozzles, errors in the landing positions, and the like.

A CCD area sensor, in which plural light-receiving elements (photoelectric converting elements) are arrayed two-dimensionally at a light-receiving surface, can suitably be used in the print detecting section 124 of the present example. The area sensor has an image pickup range that can pick-up at least the entire region of the ink ejecting width (the image recording width) of the respective heads 112K, 112C, 112M, 112Y. The print detecting section 124 may be a structure that realizes the required image pickup range by a single area sensor. Or, the print detecting section 124 may be a structure that ensures the required image pickup range by combining (joining together) plural area sensors. Or, the print detecting section 124 can be a structure in which an area sensor is supported by a moving mechanism (not shown), and the required image pickup range is picked-up by moving (scanning) the area sensor.

A line sensor can be used instead of an area sensor. In this case, the line sensor is preferably a structure having a light-receiving element row (a row of photoelectric converting elements) that is wider than at least the ink ejecting width (the image forming width) of the respective heads 112K, 112C, 112M, 112Y.

In this way, the print detecting section 124 includes an image sensor, and reads-out the image that is printed on the recording paper 116, and carries out the necessary signal processings and the like and detects the printed state (the presence/absence of ejection, errors in landing positions, dot shapes, optical density, and the like), and provides the results of detection to a printing control section that controls printing.

An after drying section 142 is provided at the stage after the print detecting section 124. The after drying section 142 has, for example, a heating fan that dries the image surface that has been printed. It is preferable that contact with the printed surface be avoided until the ink after printing has dried. Accordingly, it is preferable that the after drying section 142 be a type that blows-out hot air.

In cases of printing on a porous paper by using a dye-based ink, or the like, contact with substances that cause destruction of the dye molecules, such as ozone and the like, is prevented by closing-up the holes of the paper by applying pressure thereto. In this way, there is the effect of improving the weatherability of the image.

A heating/pressurizing section 144 is provided at the stage after the after drying section 142. The heating/pressurizing section 144 controls the degree of gloss of the image surface. The heating/pressurizing section 144, while heating the image surface, applies pressure by a pressure-applying roller 145 that has predetermined protruding and recessed shapes at the surface thereof, and transfers the protruding and recessed shapes to the image surface.

The printed matter that is generated in this way is discharged from the paper discharging section 126. It is preferable to separately discharge the actual image that is supposed to be printed originally (the print of the image that is the object) and a test print. The inkjet recording device 110 is provided with a sorting section (not shown) that sorts the printed matter of the actual image and the printed matter of the test printing, and switches the paper discharging path in order to feed them to discharging sections 126A, 126B, respectively.

Note that, in cases in which the inkjet recording device 110 simultaneously and in parallel forms an actual image and a test print on a larger-sized sheet, the test print portion is cut-off by a cutter 148. Further, a sorter (not shown) that accumulates images per order is provided at the discharging section 126A of the actual images.

The structure of the head will be described next. The structures of the respective heads 112K, 112C, 112M, 112Y of the different colors are the same. Therefore, when description is given hereinafter without differentiating therebetween, the letter at the end of the reference numeral is omitted, and the head is merely called the head 112.

Figure 3:
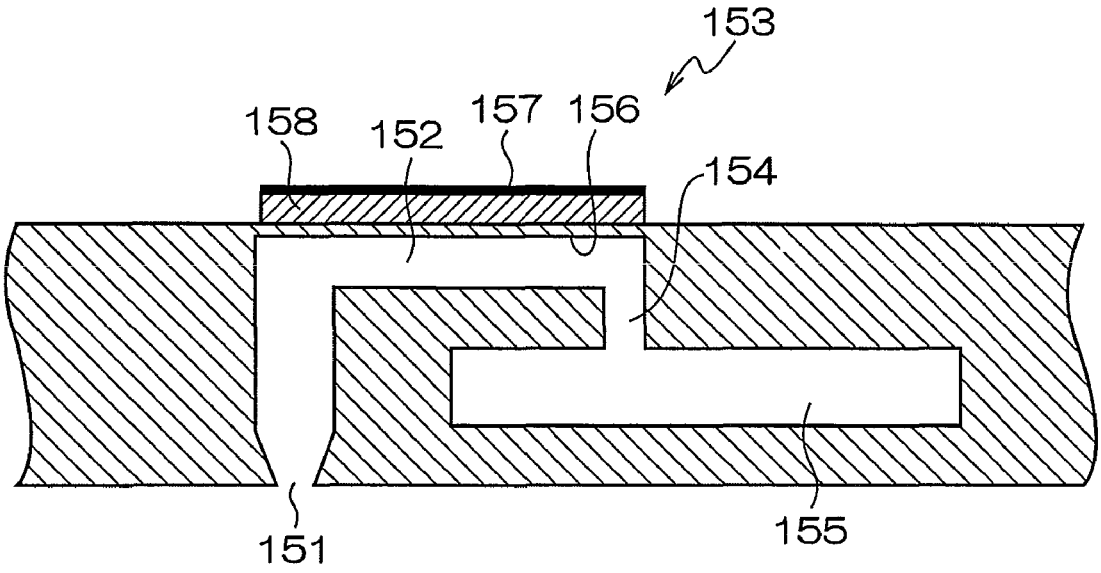
FIG. 3 is a cross-sectional view showing the three-dimensional structure of a droplet ejecting element that is provided per nozzle of a head (an ink chamber unit corresponding to one nozzle)

FIG. 3 is a cross-sectional view showing the three-dimensional structure of a droplet ejecting element that is provided per nozzle of the head 112 (an ink chamber unit corresponding to one nozzle 151). Note that, in the present exemplary embodiment, in order to make the pitch of the dots that are printed on the recording paper 116 be dense, the nozzle pitch at the head 112 is made to be dense. Specifically, the head 112 has a structure in which plural ink chamber units (droplet ejecting elements) 153, that are formed from pressure chambers 152 and the like and that respectively correspond to the nozzles 151, are arranged in a staggered form in a matrix (two-dimensionally). Due thereto, increased density of the nozzle intervals (the projected nozzle pitch), that are projected so as to be lined-up along the longitudinal direction of the head (the direction orthogonal to the paper feeding direction), is achieved at the head 112.

As shown in FIG. 3, the respective pressure chambers 152 communicate with a common flow path 155 via supply openings 154. The common flow path 155 communicates with a main tank 160 that is an ink supply source. Therefore, the ink that is supplied from the main tank 160 is distributed and supplied to the respective pressure chambers 152 via the common flow path 155.

An actuator 158 having an individual electrode 157 is joined to a pressure-applying plate (a vibrating plate that also functions as a common electrode) 156 that structures a surface of the pressure chamber 152 (the ceiling surface in FIG. 3). Due to driving voltage being applied between the individual electrode 157 and the common electrode, the actuator 158 deforms, the volume of the pressure chamber 152 changes, and, due to the change in pressure, ink is ejected from the nozzle 151. Note that a piezoelectric element, that uses a piezoelectric body of lead zirconate titanate or barium titanate or the like, is used as the actuator 158. After the ink is ejected, when the displacement of the actuator 158 returns to the original state, new ink is refilled into the pressure chamber 152 through the supply opening 154 from the common flow path 155.

The driving of the actuators 158 that correspond to the respective nozzles 151 is controlled in accordance with dot arrangement data generated from the image information. Ink drops can thereby be ejected from the nozzles 151. As explained in FIG. 1, while the recording paper 116 that is the recording medium is conveyed at a uniform speed in the sub-scanning direction, the ink ejecting timings of the respective nozzles 151 are controlled in accordance with the conveying speed. The desired image can thereby be recorded on the recording paper 116.

In implementing the present invention, the arranged structure of the nozzles is not limited to the arrangement that is described above. Further, the present exemplary embodiment employs a system in which the ink drops are jetted-out by deformation of the actuators 158 that are exemplified by piezo elements (piezoelectric elements). However, in implementing the present invention, the method of ejecting ink is not particularly limited. Instead of a piezo jetting method, various types of methods such as a thermal jetting method, in which ink is heated by a heat-generating body such as a heater or the like and air bubbles are generated and ink drops are jetted-out due to the pressure thereof, or the like can be applied to the inkjet recording device 110.

Figure 4:
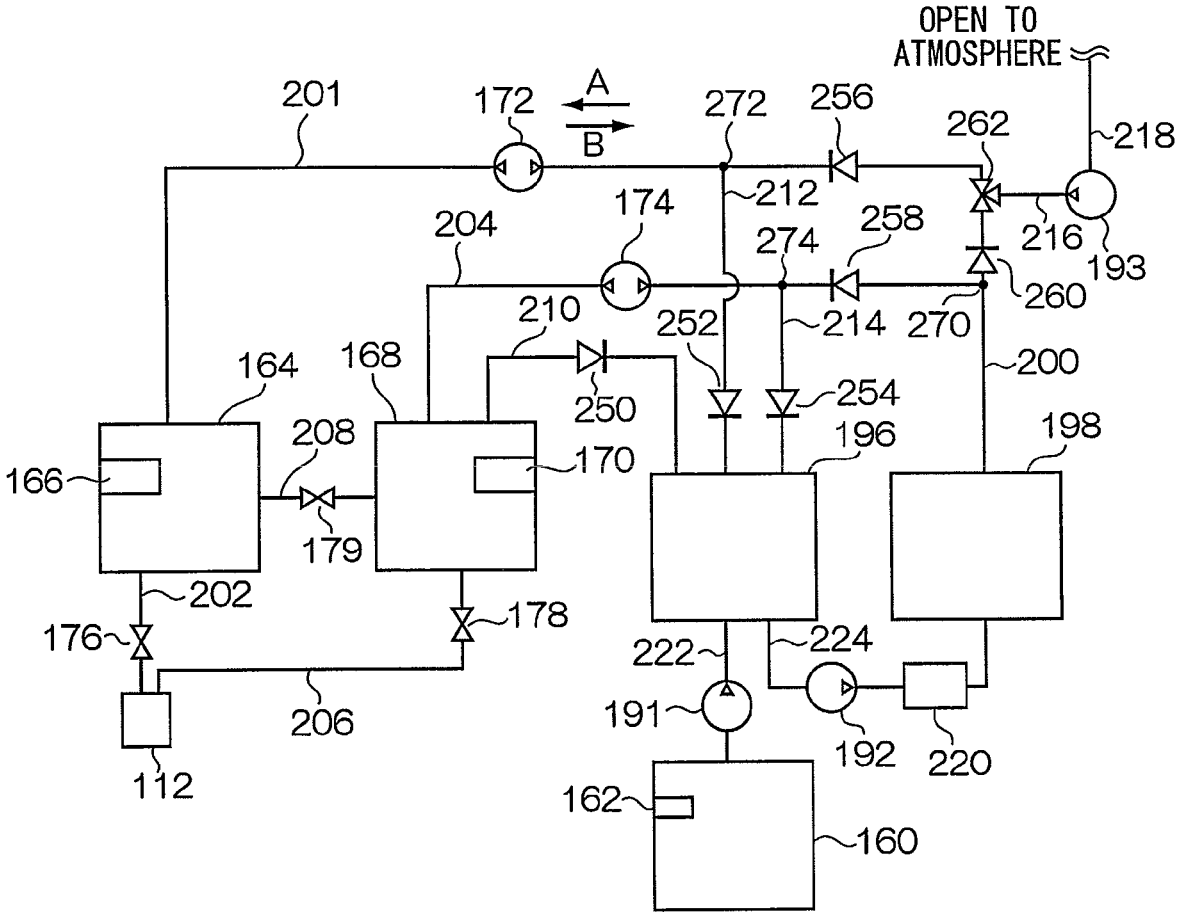
FIG. 4 is a structural drawing of an ink storing/loading section relating to the present exemplary embodiment.

The detailed structure of the ink storing/loading section 114 relating to the present exemplary embodiment will be described here. FIG. 4 is a structural drawing of the ink storing/loading section 114 relating to the present exemplary embodiment. The ink storing/loading sections 114 are provided in correspondence with the respective heads 112K, 112C, 112M, 112Y Because the respective ink storing/loading sections 114 have the same structure, here, one ink storing/loading section 114 will be described exemplarily.

The ink storing/loading section 114 has the main tank 160 that stores the ink. Further, the ink storing/loading section 114 has a first buffer tank 196 and a second buffer tank 198 that temporarily stores the ink.

The main tank 160 communicates with the first buffer tank 196 via an ink flow path 222. A third circulating pump 191 for feeding ink from the main tank 160 to the first buffer tank 196 is provided at the ink flow path 222.

Further, the first buffer tank 196 communicates with the second buffer tank 198 via an ink flow path 224. A fourth circulating pump 192 for feeding ink from the first buffer tank 196 to the second buffer tank 198 is provided at the ink flow path 224.

A degassing section 220 is provided on the ink flow path 224. The degassing section 220 degasifies the gas within the ink that is fed from the first buffer tank 196. The method of degassing by the degassing section 220 is not particularly limited, and a known method can be utilized. For example, reduced pressure degasification, application of ultrasonic waves, and the like are examples of the degassing method of the degassing section 220. When using reduced pressure degasification, a pressure controlling mechanism and a vacuum pump via a reduced pressure tank are provided, and reduced pressure suction in accordance with static pressure that has been adjusted is carried out.

Due to this structure, ink is supplied from the main tank 160 to the first buffer tank 196 by the third circulating pump 191. Further, ink within the first buffer tank 196 is supplied to the second buffer tank 198 by the fourth circulating pump 192. Moreover, the degassing section 220 is provided between the first buffer tank 196 and the second buffer tank 198. Therefore, the ink within the second buffer tank 198 is always the ink that has been subjected to degassing process. Namely, in the present exemplary embodiment, a degassing mechanism is structured by the first buffer tank 196, the second buffer tank 198, the degassing section 220, the ink flow path 222, the ink flow path 224 and the fourth circulating pump 192.

One end of an ink flow path 200 is connected to the second buffer tank 198. The other end of the ink flow path 200 is connected to a three-way valve 262. One end of an ink flow path 201 is connected to the three-way valve 262. The other end of the ink flow path 201 is connected to a supply tank 164. Further, a fifth circulating pump 193 is connected to the three-way valve 262 via a pipe 216. A pipe 218 that is open to the atmosphere is connected to the fifth circulating pump 193.

The three-way valve 262 is switched between a state in which the ink flow path 200 and the ink flow path 201 communicate (called a first state hereinafter), and a state in which the pipe 216 and the ink flow path 201 communicate (called a second state hereinafter). The three-way valve 262 is usually switched to the first state, and is switched to the second state only in "air bubble injecting process" which will be described later.

In the state in which the three-way valve 262 is switched to the first state, the second buffer tank 198 and the supply tank 164 communicate via the ink flow path 200 and the ink flow path 201. Further, the supply tank 164 communicates with the common flow path 155 of the head 112 via an ink flow path 202. Due thereto, the ink, that is to be supplied to the common flow path 155 of the head 112, flows into the supply tank 164 via the ink flow paths 200, 201, and is temporarily stored. Further, the ink that is recovered from the common flow path 155 of the head 112, flows into the supply tank 164 via the ink flow path 202, and is temporarily stored.

On the other hand, a branch point 270 is provided on the ink flow path 200. An ink flow path 204 is connected to the branch point 270. The second buffer tank 198 and a recovery tank 168 communicate via the ink flow path 200 and the ink flow path 204. Further, the recovery tank 168 communicates with the common flow path 155 of the head 112 via an ink flow path 206. Note that the end portion of the ink flow path 206 is connected to a different portion of the common flow path 155 than the portion thereof to which the ink flow path 202 is connected. Due thereto, the ink, that is to be supplied to the common flow path 155 of the head 112, flows into the recovery tank 168 via the ink flow path 204, and is temporarily stored. Further, the ink that is recovered from the common flow path 155 of the head 112, flows into the recovery tank 168 via the ink flow path 206, and is temporarily stored.

A first solenoid valve 176 that can open and close the ink flow path 202 is provided on the ink flow path 202. A second solenoid valve 178 that can open and close the ink flow path 206 is provided on the ink flow path 206.

The supply tank 164 and the recovery tank 168 directly communicate via an ink flow path 208. A third solenoid valve 179 that can open and close the ink flow path 208 is provided on the ink flow path 208.

The other end of an ink flow path 212, whose one end is connected to a branch point 272 that is on the ink flow path 201, is connected to the first buffer tank 196. Further, the other end of an ink flow path 214, whose one end is connected to a branch point 274 on the ink flow path 204, is connected to the first buffer tank 196. Moreover, the other end of an ink flow path 210, whose one end is connected to the recovery tank 168, is connected to the first buffer tank 196.

A sixth flow-regulating valve 260 is provided between the branch point 270 of the ink flow path 200 and the three-way valve 262. The sixth flow-regulating valve 260 does not impede the flow of ink from the second buffer tank 198 toward the three-way valve 262, but does impede the reverse flow of ink from the three-way valve 262 to the second buffer tank 198.

A fourth flow-regulating valve 256 is provided between the branch point 272 of the ink flow path 201 and the three-way valve 262. The fourth flow-regulating valve 256 does not impede the flow of ink from the three-way valve 262 toward the supply tank 164, but impedes the reverse flow of ink from the supply tank 164 to the three-way valve 262. Moreover, a first circulating pump 172 that can rotate forward and reversely is provided on the ink flow path 201 between the branch point 272 and the supply tank 164. When rotating forward, the first circulating pump 172 feeds ink from the branch point 272 side to the supply tank 164 side (in the A direction in the drawing). When rotating reversely, the first circulating pump 172 feeds ink from the supply tank 164 side to the branch point 272 side (in the B direction in the drawing).

A fifth flow-regulating valve 258 is provided between the branch point 270 of the ink flow path 204 and the branch point 274. The fifth flow-regulating valve 258 does not impede the flow of ink from the second buffer tank 198 toward the branch point 274, but impedes the reverse flow of ink from the branch point 274 to the second buffer tank 198. Moreover, a second circulating pump 174, that can rotate forward and reversely, is provided on the ink flow path 204 between the branch point 274 and the recovery tank 168. When rotating forward, the second circulating pump 174 feeds ink from the recovery tank 168 side to the branch point 274 side (in the B direction in the drawing). When rotating reversely, the second circulating pump 174 feeds ink from the branch point 274 side to the recovery tank 168 side (in the A direction in the drawing).

A first flow-regulating valve 250 is provided on the ink flow path 210. The first flow-regulating valve 250 does not impede the flow of ink from the recovery tank 168 to the first buffer tank 196, but impedes the reverse flow of ink from the first buffer tank 196 to the recovery tank 168.

A second flow-regulating valve 252 is provided on the ink flow path 212. The second flow-regulating valve 252 does not impede the flow of ink from the branch point 272 to the first buffer tank 196, but impedes the reverse flow of ink from the first buffer tank 196 to the branch point 272.

A third flow-regulating valve 254 is provided on the ink flow path 214. The third flow-regulating valve 254 does not impede the flow of ink from the branch point 274 to the first buffer tank 196, but impedes the reverse flow of ink from the first buffer tank 196 to the branch point 274.

A liquid surface sensor 162, that detects the liquid surface of the ink of the main tank 160, is provided at the main tank 160. When the liquid surface sensor 162 detects that the ink liquid surface has fallen and the remaining amount of ink is low, an ink supply controlling section 190 (that will be described later) gives notice of this fact via a display device (not shown) or the like. Further, a first pressure sensor 166 is provided at the supply tank 164, and the pressure within the supply tank 164 is measured by the first pressure sensor 166. Moreover, a second pressure sensor 170 is provided at the recovery tank 168, and the pressure within the recovery tank 168 is measured by the second pressure sensor 170. The application of pressure to the ink is adjusted in accordance with the results of measurement of the first pressure sensor 166 and the second pressure sensor 170.

Due to the above-described structure, a circulating path is formed that circulates the ink through the second buffer tank 198, the supply tank 164, the recovery tank 168 and the first buffer tank 196.

Note that, in the present exemplary embodiment, the path that is formed by the ink flow path 200, the ink flow path 201 and the ink flow path 202 is called an ink supply path 180. The path that is formed from the ink flow path 204, the ink flow path 206 and the ink flow path 214 is called an ink recovery path 182.

Further, hereinafter, description will be given with the common flow path 155 omitted. For example, "the supplying of ink to the common flow path 155 of the head 112" will be expressed merely as "the supplying of ink to the head 112" or "the supplying of ink to the head 112 interior".

Figure 5:
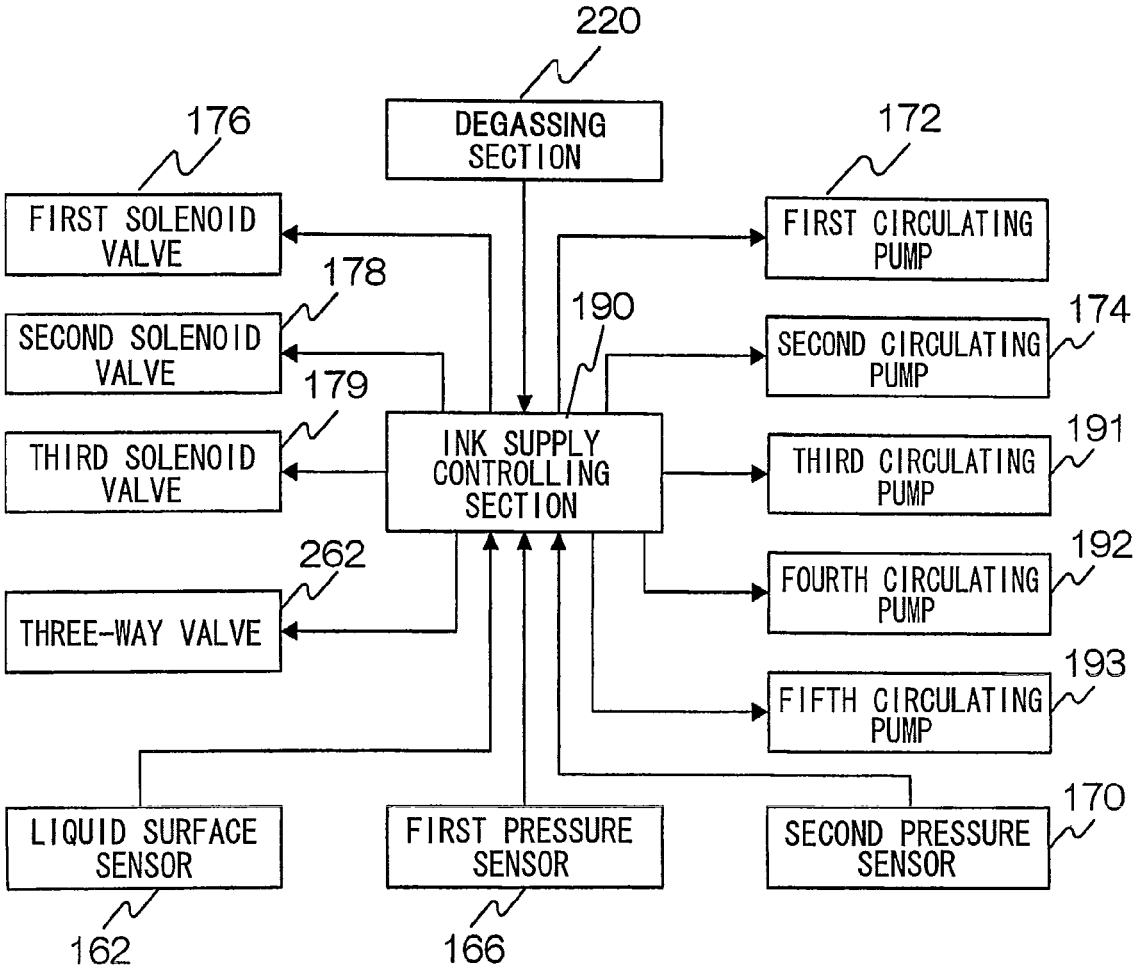
FIG. 5 is a structural drawing showing the structure of a control system that controls the ink feeding operation of the ink storing/loading section.

FIG. 5 is a structural drawing showing the structure of a control system that controls the ink feeding operations of the ink storing/loading section 114. As shown in FIG. 5, connected to the ink supply controlling section 190 are the liquid surface sensor 162, the first pressure sensor 166, the second pressure sensor 170, the first circulating pump 172, the second circulating pump 174, the third circulating pump 191, the fourth circulating pump 192, the fifth circulating pump 193, the first solenoid valve 176, the second solenoid valve 178, the third solenoid valve 179, the three-way valve 262 and the degassing section 220.

The results of measurement of the liquid surface sensor 162, the first pressure sensor 166 and the second pressure sensor 170 are inputted to the ink supply controlling section 190. At times of usual recording operation, the ink supply controlling section 190 drives the first circulating pump 172 and the second circulating pump 174 on the basis of the results of measurement of the first pressure sensor 166 and the second pressure sensor 170. Further, the ink supply controlling section 190 effects control such that the pressure within the supply tank 164 is a constant value higher than the pressure within the recovery tank 168 (i.e., such that the pressure difference between the supply tank 164 and the first pressure sensor 166 is constant). At this time, the ink supply controlling section 190 controls the first solenoid valve 176 and the second solenoid valve 178 to open states, and the third solenoid valve 179 to a closed state. Further, the ink supply controlling section 190 controls and switches the three-way valve 262 to the first state. Due thereto, ink is supplied from the main tank 160 to the supply tank 164. Further, the supplied ink flows from the supply tank 164 via the head 112 toward the recovery tank 168. As a result, ink is circulated at a uniform flow speed within the circulating path that is formed from the ink supply path and the ink recovery path. The first pressure sensor 166 and the second pressure sensor 170 are sensors that are provided in devices of general circulating systems.

Note that, for pressure adjustment, the ink that is discharged from the supply tank 164 and the recovery tank 168 is returned to the first buffer tank 196 by the first flow-regulating valve 250, the second adjusting-adjusting valve 252, the third flow-regulating valve 254, the fourth flow-regulating valve 256 and the fifth flow-regulating valve 258 that are disposed as shown in FIG. 4.

The ink supply controlling section 190 is structured from a central processing unit (CPU), peripheral circuits thereof, and the like, and functions as a control device that controls the ink storing/loading section 114 overall in accordance with predetermined programs. The ink supply controlling section 190 also functions as a computing device that carries out various types of computation. The ink supply controlling section 190 is connected to a main controller that controls the overall recording operations of the inkjet recording device. Further, the ink supply controlling section 190 controls the operations of the ink storing/loading section 114 in accordance with control signals received from the main controller, and informs the main controller of abnormal states arising at the ink storing/loading section 114.

A RAM and a ROM are provided at the ink supply controlling section 190. Programs that the CPU of the ink supply controlling section 190 executes, various types of data that are needed for control, and the like are stored in the ROM. The programs that are stored in the ROM include a program of initial ink filling process that is carried out before usual recording operation, and a program of air bubble removing process that is carried out separately for air bubble removal. The ROM may be a non-rewritable storage section. In cases in which various types of data are updated as needed, it is preferable to use a rewritable storage section such as an EEPROM.

Initial ink filling process that is carried out in the present exemplary embodiment will be described next. In the initial ink filling process, while air bubbles are removed, the ink is filled into the head 112, the supply tank 164, the recovery tank 168, and the ink circulating path that includes the ink supply path, the ink recovery path and the like, of the ink storing/loading section 114.

Figure 6:
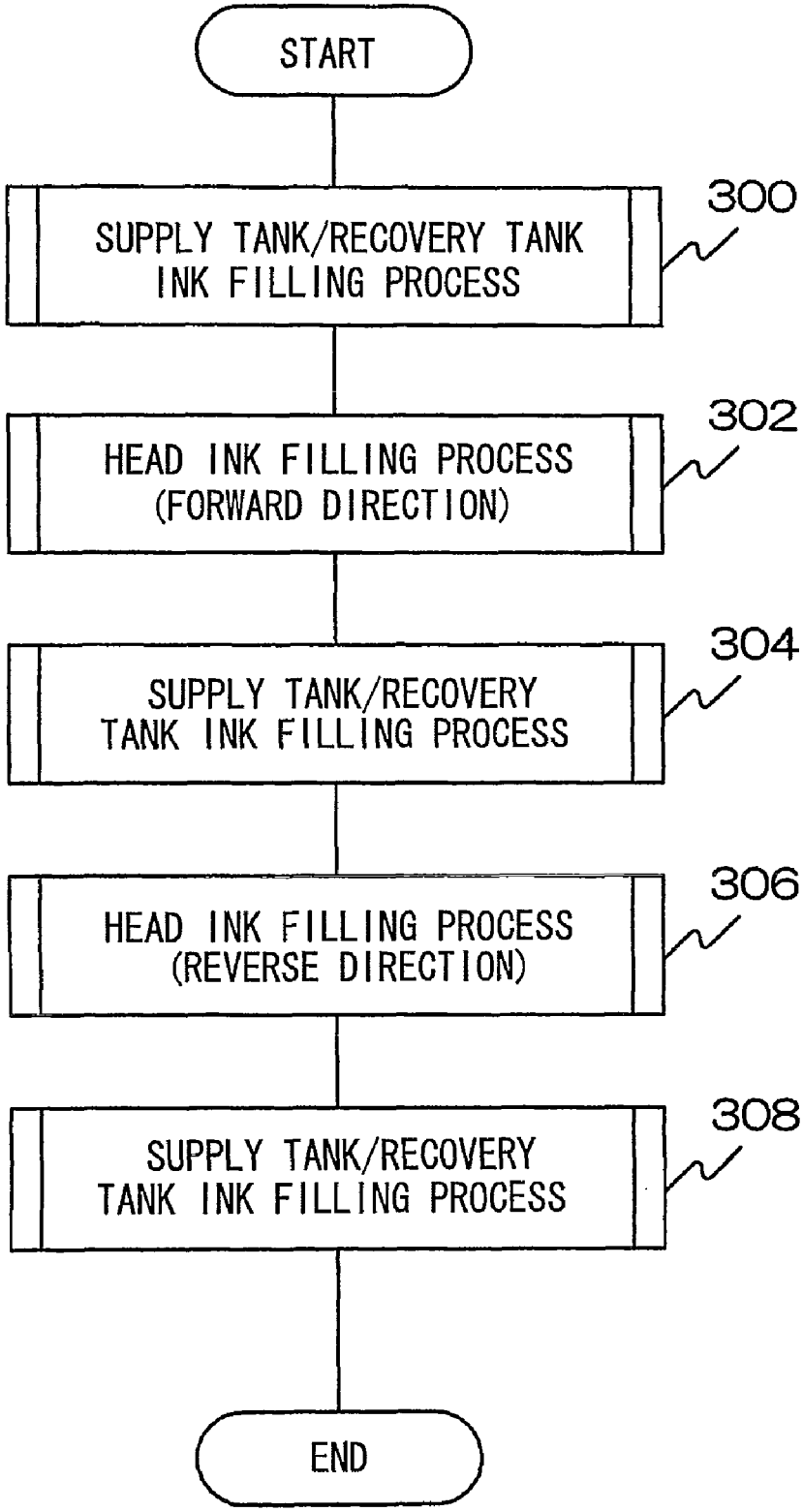
FIG. 6 is a flowchart showing the flow of a program of initial ink filling process.

FIG. 6 is a flowchart showing the flow of a program of the initial ink filling process that the ink supply controlling section 190 executes. Note that, in the initial ink filling process, the three-way valve 262 is always switched to the first state.

In step 300, ink filling process that fills ink into the supply tank 164 and the recovery tank 168 is carried out. Ink is thereby circulated from the second buffer tank 198 in the order of the supply tank 164, the recovery tank 168 and the first buffer tank 196, and ink is filled into the supply tank 164 and the recovery tank 168. Note that, the ink that is sent to the first buffer tank 196 is degassed by the above-described degassing mechanism.

In step 302, ink filling process that pressure-feeds the ink in the forward direction and fills the ink into the head 112, is carried out. The ink that is filled in the supply tank 164 in step 300 is pressure-fed from the supply tank 164 side to the head 112, and is filled within the head 112. Further, air bubbles that exist within the head 112 are discharged to the recovery tank 168. Here, forward direction means the ink circulating direction at the time of the usual recording operation.

In step 304, the same ink filling process as in step 300 is carried out. The air bubbles that are discharged from the interior of the head 112 in above-described step 302 and stay in the recovery tank 168, are sent by the same path as in step 300 to the first buffer tank 196, and ink is filled in the supply tank 164 and the recovery tank 168.

In step 306, ink filling process, that pressure-feeds ink in the direction opposite the forward direction and fills ink into the head 112, is carried out. Here, the ink is pressure-fed to the head 112 from the opposite direction as in step 302. Namely, in the initial ink filling process, ink is pressure-fed from two directions by steps 302 and 306, and the air bubbles are discharged from the head 112 interior and recovered in the supply tank 164.

In step 308, the same ink filling process as in step 300 is carried out. The air bubbles that were discharged from the interior of the head 112 and stay in the supply tank 164, are fed by the same path as in step 300 to the first buffer tank 196, and the ink is filled into the supply tank 164 and the recovery tank 168.

In this way, in the present exemplary embodiment, the ink is pressure-fed to the head 112 from the two directions of the supply tank 164 and the recovery tank 168, within the circulating path that circulates the ink to the head 112. Therefore, in the present exemplary embodiment, even if there is a complex circulating path, the air bubbles can be removed reliably and the circulating path can be filled with degassed ink.

Details of the respective ink filling process will be described next.

Figure 7:
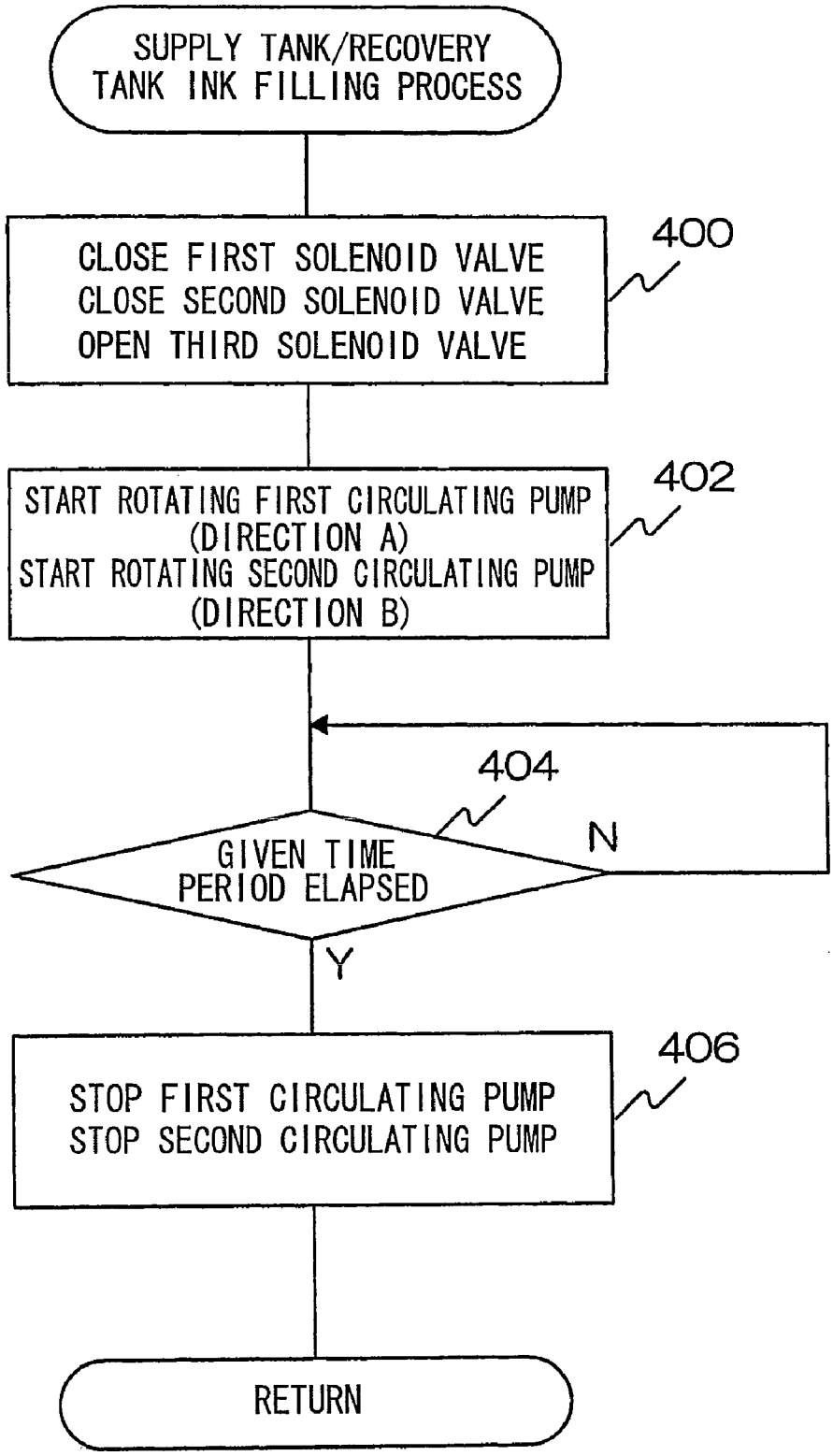
FIG. 7 is a flowchart showing the flow of ink filling process to a supply tank and a recovery tank.

FIG. 7 is a flowchart showing the flow of the ink filling process at the supply tank 164 and the recovery tank 168 that is carried out in steps 300, 304, 308.

In step 400, first, the ink supply controlling section 190 closes the first solenoid valve 176 and the second solenoid valve 178, and opens the third solenoid valve 179. Due thereto, the supply tank 164 and the recovery tank 168 are directly communicated via the ink flow path 208. Accordingly, a path is formed in which ink circulates in the order of the second buffer tank 198, the supply tank 164, the recovery tank 168, and the first buffer tank 196.

Figure 8:
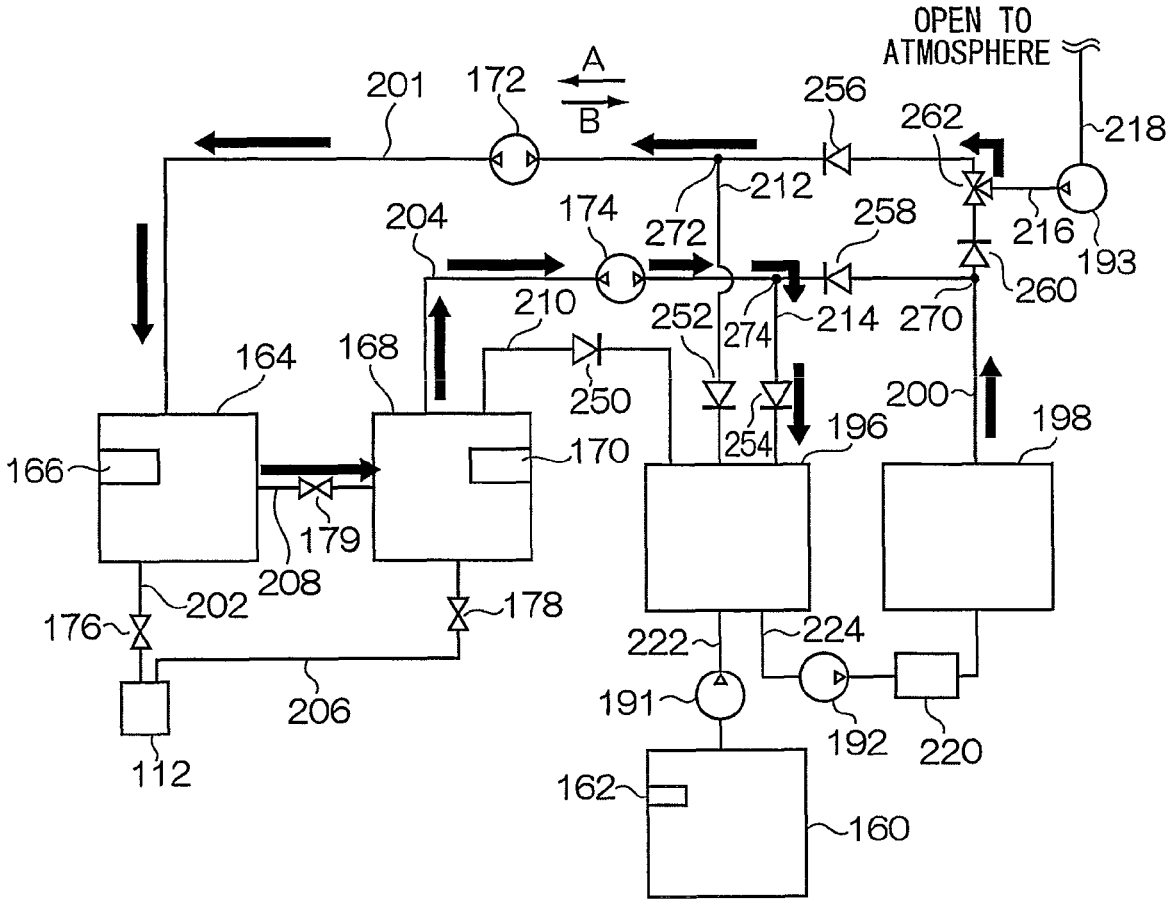
FIG. 8 is a drawing explaining a fed state of ink in the ink filling process to the supply tank and the recovery tank.

In step 402, the ink supply controlling section 190 carries out control so as to cause the first circulating pump 172 to rotate forward and ink to be fed in the ink flow path 201 in the A direction. Further, in step 402, the ink supply controlling section 190 effects control so as to cause the second circulating pump 174 to rotate forward and ink to be fed in the ink flow path 204 in the B direction. Due thereto, as shown by the thick arrows in FIG. 8, the ink that is stored in the second buffer tank 198 is fed in the order of the supply tank 164, the recovery tank 168 and the first buffer tank 196.

In step 404, the ink supply controlling section 190 judges whether or not a given time period has elapsed. If the ink supply controlling section 190 judges that the given time period has not elapsed, the ink supply controlling section 190 continues the rotation of the first circulating pump 172 and the second circulating pump 174. Further, if the ink supply controlling section 190 judges that the given time period has elapsed, in step 406, the ink supply controlling section 190 stops the rotation of the first circulating pump 172 and the second circulating pump 174.

With regard to the time period that is clocked in step 404 (the pump driving time period), a time period that is sufficient for ink to be filled into the supply tank 164, the recovery tank 168 and the circulating path formed from the ink supply path and the ink recovery path, is investigated in advance. This time period is stored and set in the ROM or the like of the ink supply controlling section 190 as the time period clocked in step 404.

Figure 9:
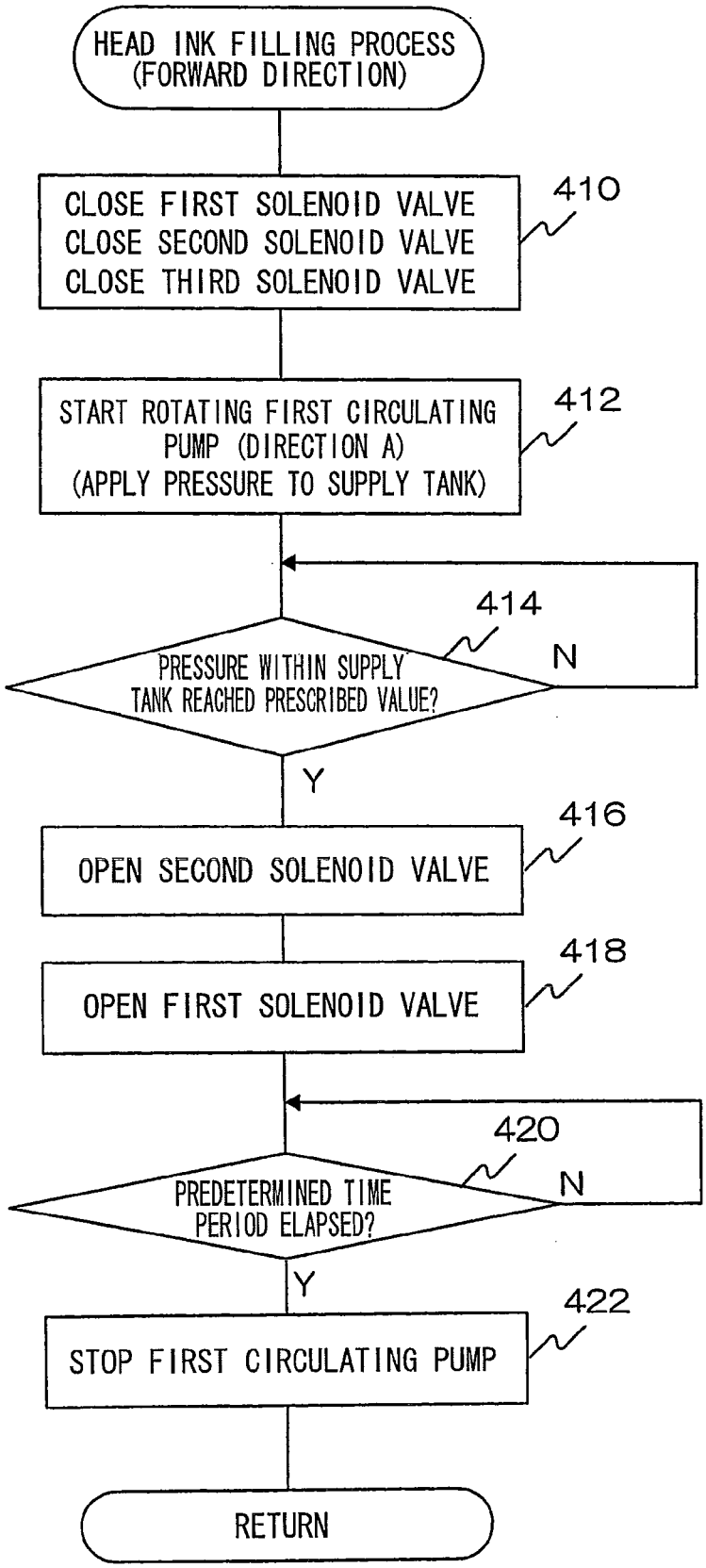
FIG. 9 is a flowchart showing the flow of ink filling process that pressure-feeds and fills ink to a head in a forward direction.

FIG. 9 is a flowchart showing the flow of the ink filling process that is carried out in FIG. 302 and pressure-feeds ink in the forward direction and fills ink into the head 112.

In step 410, first, the ink supply controlling section 190 closes the first solenoid valve 176, the second solenoid valve 178 and the third solenoid valve 179.

Figure 10:
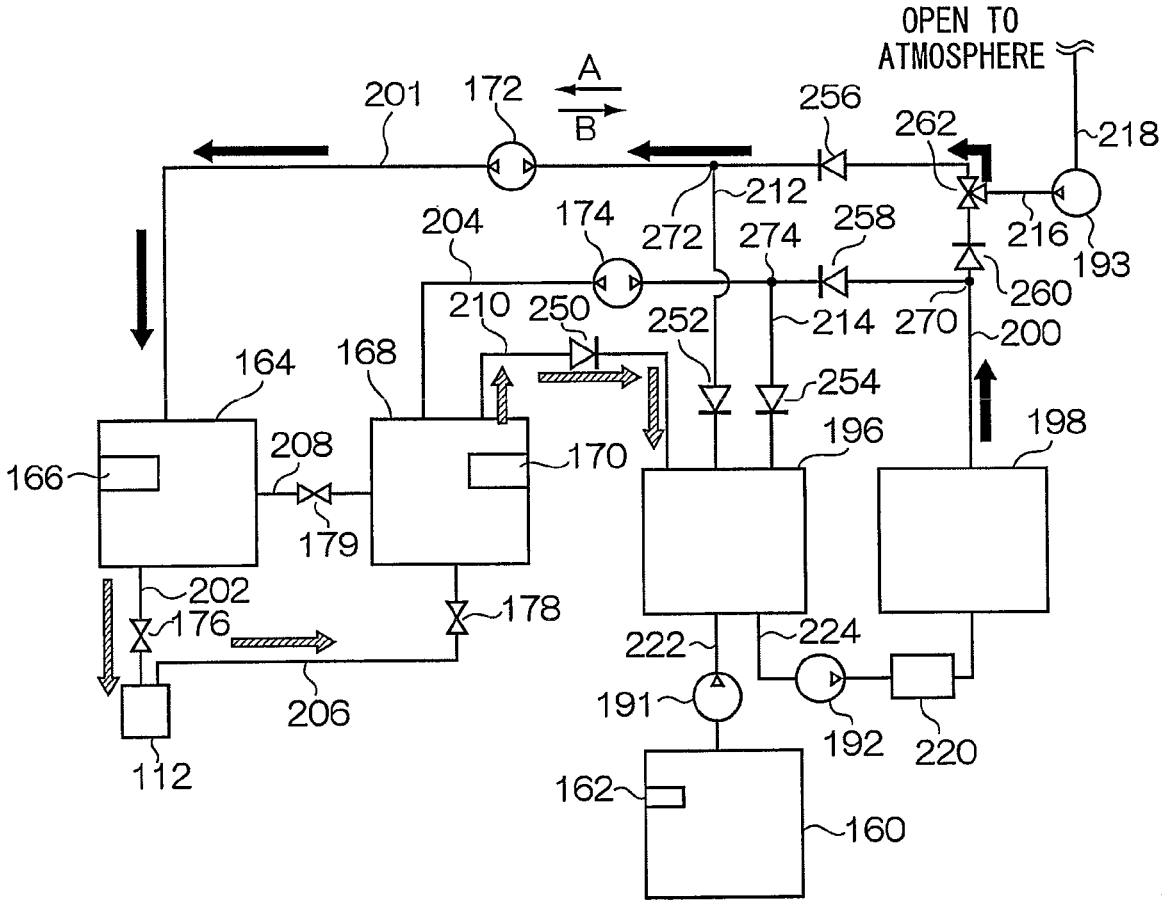
FIG. 10 is a drawing explaining a fed state of ink in the ink filling process that pressure-feeds and fills ink to the head in the forward direction.

In step 412, the ink supply controlling section 190 effects control so as to cause the first circulating pump 172 to rotate forward and ink to be fed in the ink flow path 201 in the A direction. Further, the second circulating pump 174 is set in a stopped state. Due thereto, the ink is fed as shown by the thick arrows in FIG. 10. However, because the first solenoid valve 176, the second solenoid valve 178 and the third solenoid valve 179 are all in closed states, the pressure within the supply tank 164 rises. From the start of the driving of the first circulating pump 172, the ink supply controlling section 190 monitors the pressure detection value of the first pressure sensor 166 that is provided at the supply tank 164.

In step 414, the ink supply controlling section 190 judges whether or not the pressure detection value of the first pressure sensor 166 (the pressure within the supply tank 164) has reached a prescribed value. Here, if the ink supply controlling section 190 judges that the pressure detection value has not reached the prescribed value, the ink supply controlling section 190 continues rotation of the first circulating pump 172. Further, if the ink supply controlling section 190 judges that the pressure detection value has reached the prescribed value, the routine moves on to step 416.

In step 416, the ink supply controlling section 190 opens the second solenoid valve 178. Then, in step 418, the ink supply controlling section 190 opens the first solenoid valve 176. Note that, the rotation of the first circulating pump 172 is continued. Further, the stopped state of the second circulating pump 174 is continued.

In step 420, it is judged whether or not a given time period has elapsed. The rotation of the first circulating pump 172 continues until the given time period has elapsed. Further, when it is judged in step 420 that the given time period has elapsed, in step 422, rotation of the first circulating pump 172 is stopped.

In this ink filling process, when the pressure within the supply tank 164 rises to the established value, valves are opened in the order of the second solenoid valve 178 and the first solenoid valve 176, and the ink within the supply tank 164 is pressure-fed to the head 112. At this time, the ink that is pressure-fed from the supply tank 164 passes through the head 112, and while pushing the air within the head 112 out, reaches the recovery tank 168. Note that, because the second circulating pump 174 is in a stopped state, the path of the ink flow path 204 is in a blocked state. Accordingly, the ink that overflows from the recovery tank 168 is recovered in the first buffer tank 196 via the ink flow path 210. The flow of the ink after the second solenoid valve 178 and the first solenoid valve 176 are opened is shown by the hatched arrows in FIG. 10.

Figure 11:
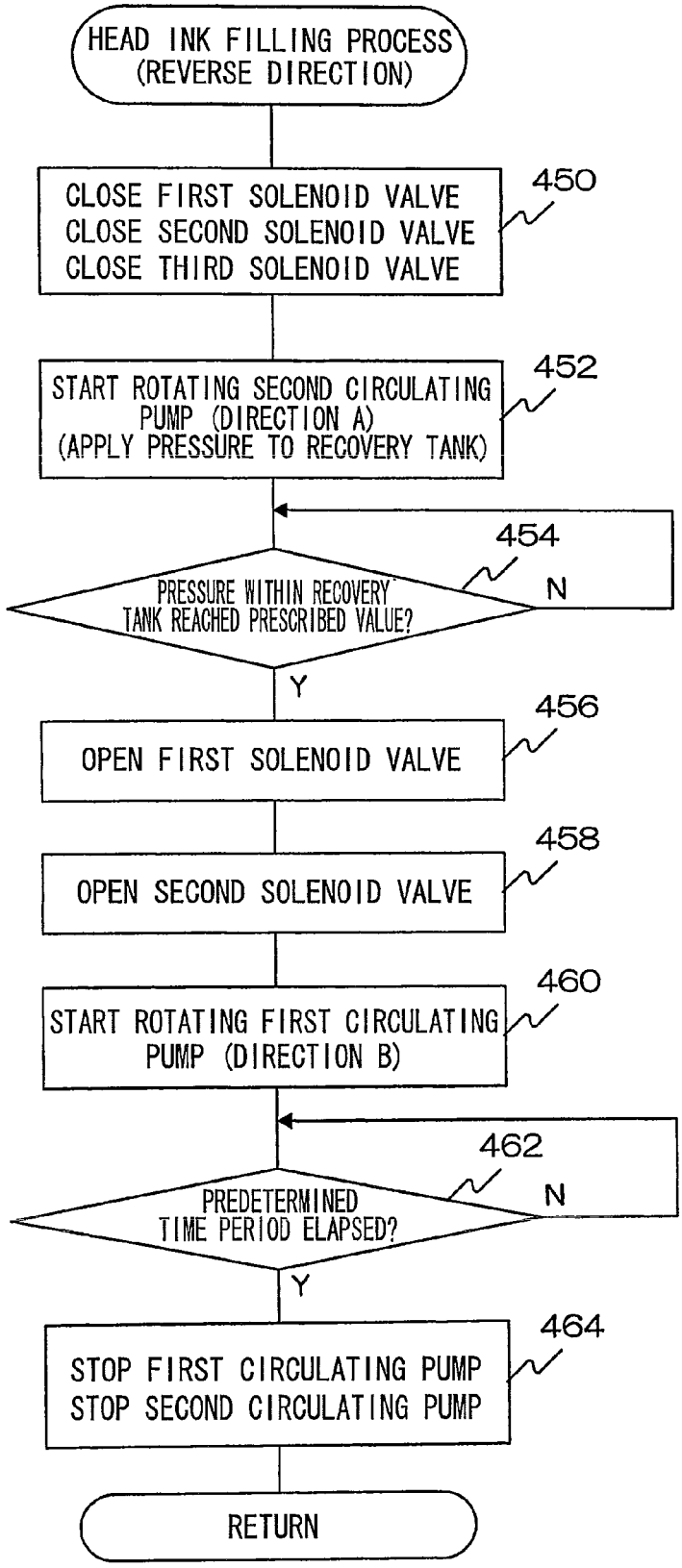
FIG. 11 is a flowchart showing the flow of ink filling process that pressure-feeds and fills ink to the head in a direction opposite the forward direction.

FIG. 11 is a flowchart showing the flow of the ink filling process that is carried out in step 306 and that pressure-feeds ink in the opposite direction and fills ink into the head 112.

In step 450, first, the ink supply controlling section 190 closes the first solenoid valve 176, the second solenoid valve 178 and the third solenoid valve 179.

Figure 12:
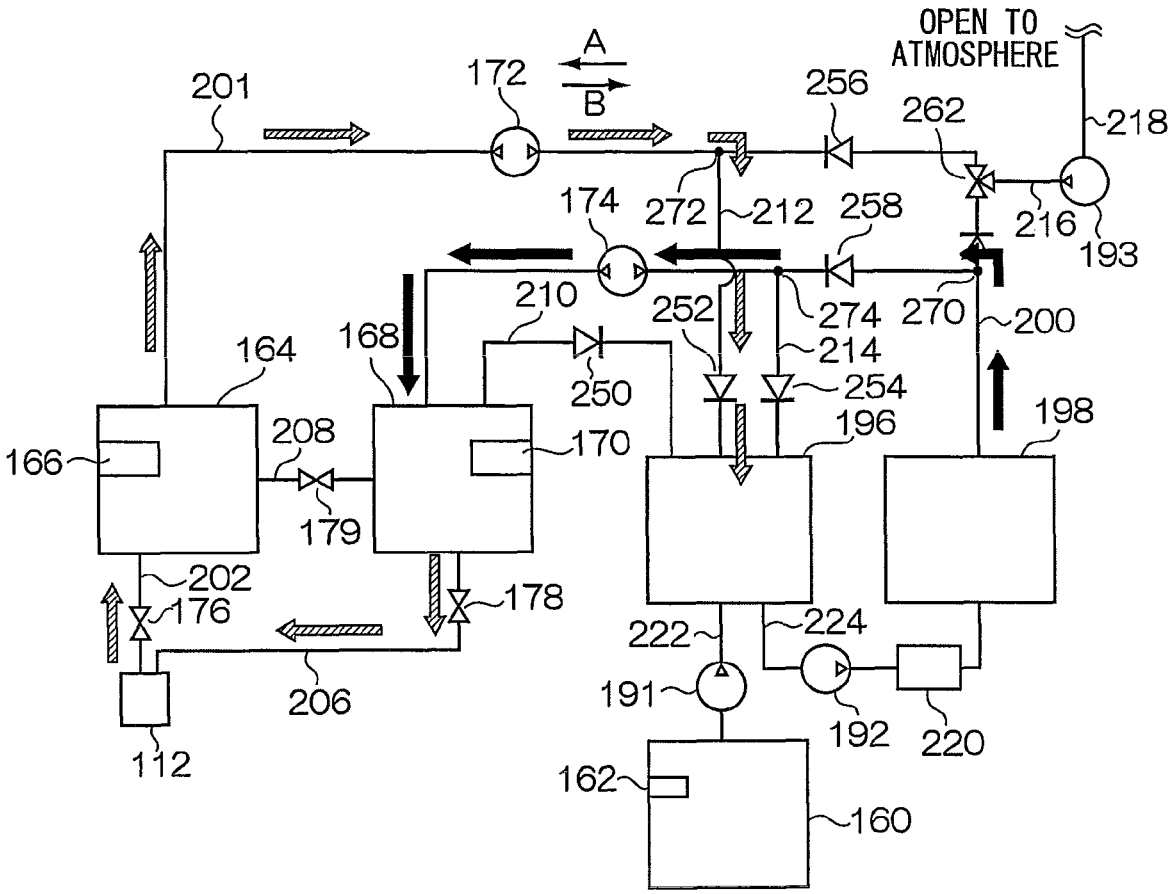
FIG. 12 is a drawing explaining the fed state of ink in the ink filling process that pressure-feeds and fills ink to the head in the direction opposite the forward direction.

In step 452, the ink supply controlling section 190 effects control so as to cause the second circulating pump 174 to rotate reversely and ink to be fed in the ink flow path 204 in the A direction. Further, the first circulating pump 172 is set in a stopped state. Due thereto, ink is fed as shown by the thick arrows in FIG. 12. However, because the first solenoid valve 176, the second solenoid valve 178 and the third solenoid valve 179 are all in closed states, the pressure within the recovery tank 168 rises. From the start of driving of the second circulating pump 174, the ink supply controlling section 190 monitors the pressure detection value of the second pressure sensor 170 that is provided at the recovery tank 168.

In step 454, the ink supply controlling section 190 judges whether or not the pressure detection value of the second pressure sensor 170 (the pressure within the recovery tank 168) has reached a stipulated value. Here, if the ink supply controlling section 190 judges that the pressure detection value has not reached the prescribed value, the ink supply controlling section 190 continues the rotation of the second circulating pump 174. Further, if the ink supply controlling section 190 judges that the pressure detection value has reached the prescribed value, the routine moves on to step 456.

In step 456, the ink supply controlling section 190 opens the first solenoid valve 176. Next, in step 458, the ink supply controlling section 190 opens the second solenoid valve 178. Note that, the rotation of the second circulating pump 174 continues. Further, in step 460, the ink supply controlling section 190 starts reverse rotation of the first circulating pump 172, and ink is fed in the B direction from the supply tank 164 to the branch point 272. Note that the rotation of the first circulating pump 172 is the same as that of the second circulating pump 174, or rotates at a speed that is slightly slower.

In step 462, it is judged whether or not a given time period has elapsed. Rotation of the first circulating pump 172 and the second circulating pump 174 continue until the given time period has elapsed. Further, when it is judged in step 462 that the given time period has elapsed, in step 464, the rotation of the first circulating pump 172 and the second circulating pump 174 is stopped.

In this ink filing process, when the pressure within the recovery tank 168 rises to the established value, the valves are opened in the order of the first solenoid valve 176 and the second solenoid valve 178, and ink within the recovery tank 168 is pressure-fed to the head 112. The ink that is pressure-fed from the recovery tank 168 passes through the head 112, and while pushing the air within the head 112 out, reaches the supply tank 164. Note that the first circulating pump 172 is in a reversely-rotating state at this time. Therefore, the ink that overflows from the supply tank 164 flows in the B direction through the path of the ink flow path 201, and, due to operation of the fourth flow-regulating valve 256, flows from the branch point 272 into the ink flow path 212, and is recovered in the first buffer tank 196. The flow of the ink after the first solenoid valve 176 and the second solenoid valve 178 are opened is shown by the hatched arrows in FIG. 12.

Note that this ink filling process is structured such that the first circulating pump 172 is driven and the ink that is recovered from the supply tank 164 is recovered in the first buffer tank 196 via the ink flow path 212. However, the ink filling process is not limited to the same, and ink may be recovered in the first buffer tank 196 by providing a flow path that directly communicates the supply tank 164 and the first buffer tank 196.

The initial ink filling process (FIG. 6) in the present exemplary embodiment describes an example in which the ink filling process that pressure-feeds ink in the forward direction to the head 112 is carried out first, and the ink filling process that pressure-feeds ink in the direction opposite the forward direction is carried out. However, the initial ink filling process may be such that ink filling process that pressure-feeds ink to the head 112 in the opposite direction is carried out first, and thereafter, ink filling process that pressure-feeds ink in the forward direction is carried out.

The ink storing/loading section 114 that is exemplified in the present exemplary embodiment circulates ink from the supply tank 164 to the recovery tank 168 via the head 112. Therein, as described above, the first circulating pump 172 and the second circulating pump 174 are driven while the first pressure sensor 166 and the second pressure sensor 170 are monitored. Further, the internal pressure of the supply tank 164 must be controlled so as to become greater than the internal pressure of the recovery tank 168, and ink circulated by this pressure difference. However, in a case in which the average value of the pressures of the supply tank 164 and the recovery tank 168 is greater than atmospheric pressure, the ink leaks-out from the nozzles 151 of the head 112. Therefore, it is required that the supply tank 164 and the recovery tank 168 be controlled to be lower than atmospheric pressure. In this case, because the internal pressures of both the supply tank 164 and the recovery tank 168 are negative pressure with respect to atmospheric pressure, air bubbles become mixed-in through the tank wall surfaces. Further, for similar reasons, air bubbles similarly become mixed-in also at the joint portions of the pipes of the respective flow paths structuring the circulating path. Accordingly, air bubbles are always generated within the ink flow paths.

The small air bubbles, that exist in the small diameter paths such as within the respective ink flow paths and within the head 112, can be removed by pressure-feeding ink as described above. However, at portions that have large sectional surface areas such as within the supply tank 164 and the recovery tank 168 and the like, there are portions where the flow of ink stagnates. Therefore, air bubbles that exist in a state of being stuck to the tank wall surfaces, cannot be removed by the above-described pressure-feeding of the ink. If these air bubbles are left for a long period of time, they lead to coagulating of ink and become a cause of clogging of the circulating path.

Thus, in the present exemplary embodiment, the air bubble removing sequence that is described hereinafter is carried out, and the air bubbles within the circulating path are reliably removed.

Figure 13:
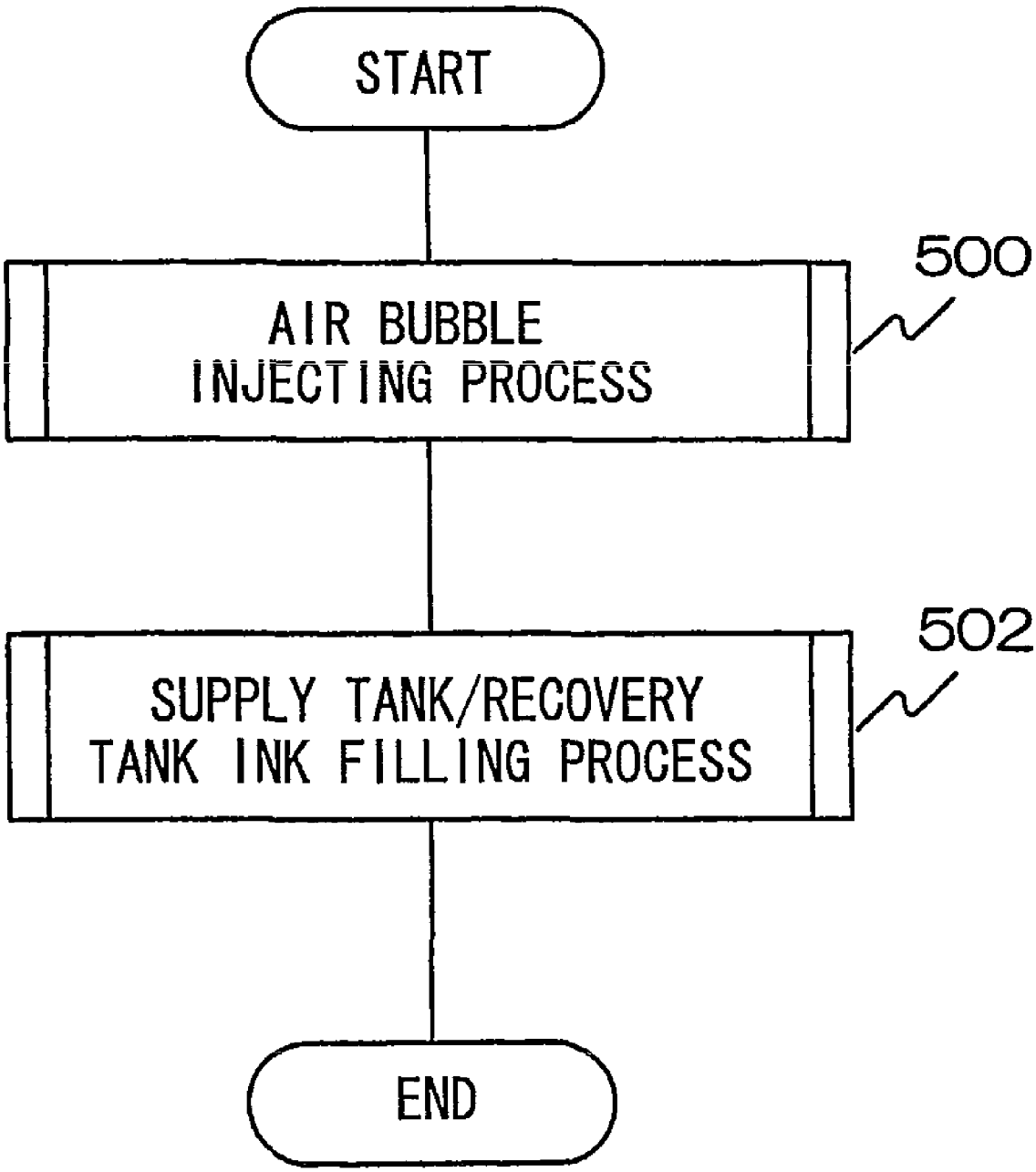
FIG. 13 is a flowchart showing the flow of a program of air bubble removing process.

FIG. 13 is a flowchart showing the flow of a program of air bubble removing process that the ink supply controlling section 190 executes.

In step 500, the ink supply controlling section 190 carries out the process of injecting air bubbles. Here, large air bubbles are injected into the ink flow path 201, and the first circulating pump 172 and the fifth circulating pump 193 are driven such that the air bubbles pass through the interiors of the supply tank 164, the recovery tank 168 and the first buffer tank 196. The injected bubbles merge with the small bubbles that exist at the tank wall surfaces such that a large air bubble is formed at one place within the path.

In step 502, the ink supply controlling section 190 carries out ink filling process that is the same as in step 300. Due thereto, the large air bubble that was formed in step 500 is sent to the first buffer tank 196, and, due to the replenishing of ink from the main tank 160 and the degassing process by the degassing section 220, the air bubbles within the path are completely removed.

The air bubble injecting process that is carried out in step 500 will be described in detail here. Note that, because the process that is carried out in step 502 is the same as the process that is carried out in previously-described step 300, description thereof is omitted.

Figure 14:
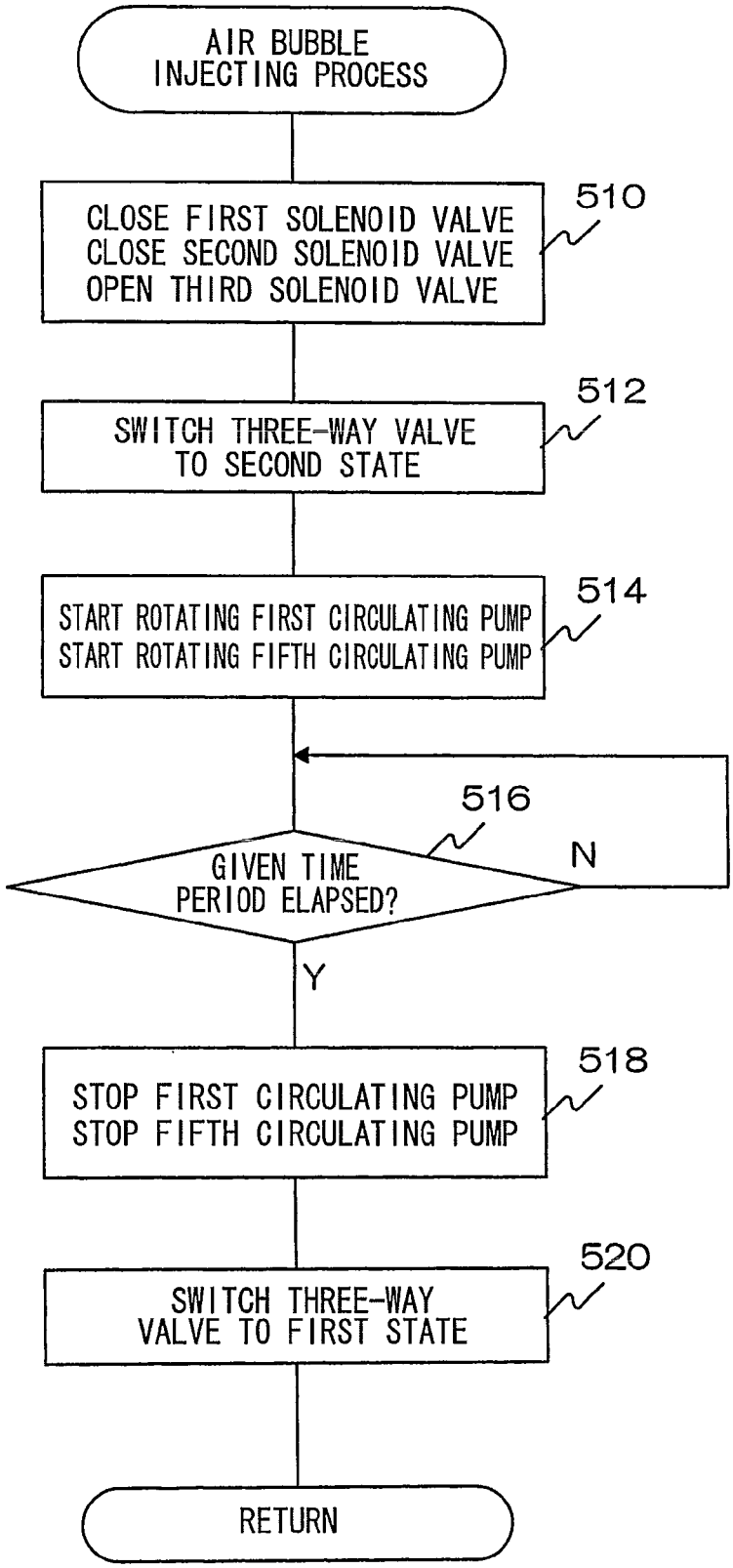
FIG. 14 is a flowchart showing the flow of a program of air bubble injecting process.

FIG. 14 is a flowchart showing the flow of the air bubble injecting process that is carried out in step 500.

In step 510, first, the ink supply controlling section 190 closes the first solenoid valve 176 and the second solenoid valve 178, and opens the third solenoid valve 179. Due thereto, the supply tank 164 and the recovery tank 168 are directly communicated via the ink flow path 208. Accordingly, a path through which the ink and air bubbles are fed is formed in the order of the ink flow path 201, the supply tank 164, the ink flow path 208 and the recovery tank 168, without going through the head 112.

In step 512, the ink supply controlling section 190 switches the three-way valve 262 to the second state. Due thereto, the pipe 216 and the ink flow path 201 communicate, and a path that sends the air bubbles from the fifth circulating pump 193 to the supply tank 164 is formed.

In step 514, the ink supply controlling section 190 causes the fifth circulating pump 193 to rotate, and injects a given amount of air into the ink flow path 201. Further, the ink supply controlling section 190 causes the first circulating pump 172 to rotate forward, and sends the injected air bubbles to the supply tank 164. Note that, here, the second circulating pump 174 is set in a stopped state. Accordingly, the ink that overflows out from the recovery tank 168 passes through the ink flow path 210 and is recovered at the first buffer tank 196.

In step 516, the ink supply controlling section 190 judges whether or not a given time period has elapsed. If the ink supply controlling section 190 judges that the given time period has not elapsed, the ink supply controlling section 190 continues the rotation of first circulating pump 172 and the fifth circulating pump 193 of step 516. Further, if the ink supply controlling section 190 judges that the given time period has elapsed, in step 518, the ink supply controlling section 190 stops the rotation of the first circulating pump 172 and the fifth circulating pump 193.

In step 520, the ink supply controlling section 190 switches the three-way valve 262 to the first state.

Due to this air bubble injecting process, the air bubbles injected by rotation of the fifth circulating pump 193 and the air bubbles that exist at the tank wall surfaces merge together, and a large air bubble is formed at one place within the path.

In this state, the ink filling process with respect to the supply tank 164 and the recovery tank 168, that was described by using FIG. 7, is carried out. Due thereto, the aforementioned large air bubble that is formed in the path is sent to the first buffer tank 196. The air bubble that is recovered in the first buffer tank 196 is subjected to degassing process by the degassing section 220, and ink, that is in a state in which air bubbles have been removed therefrom, is stored in the second buffer tank 198.

The small air bubbles, that exist at portions where the sectional surface area is large such as the supply tank 164 and the recovery tank 168 and where the flow of ink stagnates, or the like, are removed by this air bubble removing sequence.

Note that, in the air bubble injecting process of the present exemplary embodiment, an example is described in which the three-way valve 262 that connects the ink flow path 201 and the fifth circulating pump 193 is provided, and air bubbles are injected into the ink flow path 201 and are pressure-fed through the circulating path. However, the air bubble injecting process is not limited to the same. For example, a three-way valve that connects the ink flow path 204 and the fifth circulating pump 193 may be provided, and air bubbles may be injected into the ink flow path 204 and pressure-fed through the circulating path.

What is claimed is:

1. A liquid ejecting device comprising:

an ejecting head including a liquid chamber configured to store a liquid, and that ejects liquid that is within the liquid chamber;

a first tank configured to temporarily store liquid that is to be supplied to the liquid chamber, and temporarily stores liquid that is recovered from the liquid chamber, and communicates with the liquid chamber;

a second tank configured to temporarily store liquid that is to be supplied to the liquid chamber, and temporarily stores liquid that is recovered from the liquid chamber, and communicates with a portion of the liquid chamber which portion is different than a portion of the liquid chamber that is in communication with the first tank;

a degas device degassing gas within recovered liquid;

a first flow path communicating the first tank and the degas device, a first pump being provided within the first flow path;

a second flow path communicating the second tank and the degas device, a second pump being provided within the second flow path; and a control section controlling the first pump and the second pump, wherein the control section, effects control such that liquid, that is degassed at the degas device, is supplied to the liquid chamber via the first flow path and the first tank, and liquid that is within the liquid chamber is recovered at the degas device via the second tank, and effects control such that liquid, that is degassed at the degas device, is supplied to the liquid chamber via the second flow path and the second tank, and liquid that is within the liquid chamber is recovered at the degas device via the first tank.

2. The liquid ejecting device of claim 1, further comprising an air bubble supplying section that supplies air bubbles to at least one of the first flow path or the second flow path, wherein the control section controls the air bubble supplying section such that air bubbles are supplied, and controls the first pump and the second pump such that liquid, that includes the supplied air bubbles, passes through the first tank and the second tank and is recovered at the degas device.

* * * * *